United States Patent [19]

Isaac

[11] 4,183,159

[45] Jan. 15, 1980

[54] PORTABLE TRANSPARENT DISPLAY DEVICE

[76] Inventor: Mark Isaac, 1894 Alberni St., Vancouver, B. C., Canada

[21] Appl. No.: 853,242

[22] Filed: Nov. 21, 1977

[51] Int. Cl.[2] ..... A44C 3/00

[52] U.S. Cl. ..... 40/1.6; 40/315; 40/586

[58] Field of Search ..... 40/1.5, 1.6, 586, 152, 40/315

[56] References Cited

U.S. PATENT DOCUMENTS

| | | | |
|---|---|---|---|
| 1,785,186 | 12/1930 | Day | 40/152 |
| 1,849,904 | 3/1952 | Bott | 40/152 |
| 2,178,024 | 10/1939 | Pompilio | 40/1.5 X |
| 2,232,060 | 2/1941 | Foster | 40/1.5 |
| 3,212,204 | 10/1965 | Smith | 40/1.5 |
| 3,407,523 | 10/1968 | Winston | 40/1.5 |

*Primary Examiner*—John F. Pitrelli
*Assistant Examiner*—G. Lee Skillington
*Attorney, Agent, or Firm*—McCarthy & McCarthy

[57] ABSTRACT

A portable transparent display device consists of two elements, viz. (1) a flexible transparent generally flat receiving element (e.g. disk-shaped), one face of which is recessed to form a receiving space, the side walls of the receiving element defining the receiving space slanting inwardly and upwardly from the bottom thereof; and (2) an insertable element, mating with and insertable into the aforesaid receiving space and removably locked into position by the inclined side walls defining the periphery of the receiving space of the receiving element. A thin paper insert or the like bearing a message or photograph, etc. may be clamped between the receiving element and the insertable element and the device used for display of the message or photograph, etc. through the transparent receiving element. The insertable element may be provided with a clasp at the rear surface for attaching the device to the clothing of the wearer.

7 Claims, 8 Drawing Figures

PORTABLE TRANSPARENT DISPLAY DEVICE

BACKGROUND OF THE INVENTION

This invention is a portable transparent display device. Conventional such devices are frequently provided with a pin or clasp for attachment to clothing of the wearer. Such devices are used to display photographs, slogans, messages and the like. Conventional devices either generally have relatively complex means for disassembly and insertion of the message or other matter displayed, or else require that the message be permanently affixed to the display device itself, thereby limiting the usefulness of the latter type of device to the particular message impressed thereon.

SUMMARY OF THE INVENTION

It is an object of the present invention to provide a portable transparent display device which is reusable and can be both simply and easily assembled and disassembled.

According to the present invention, there is provided a portable transparent display device comprised of two elements, the first of which is a flexible transparent generally flat receiving element having a recessed receiving space in one face thereof, defined by side walls which slant upwardly and inwardly from the bottom thereof. Adapted to be received and to mate with the aforesaid recessed space is an insertable generally flat element having mating inclined side walls retained in place by the side walls of the receiving element. To the rear surface of the insertable element may be conveniently mounted means for attaching the assembled device to an external object, e.g. the clothing of a wearer. The insertable element may be snap-fitted into place in the receiving space of the receiving element. The receiving element can be flexed to release the locking grip of its side walls on the mating inclined peripheral walls of the insertable element, tus permitting ready disassembly to permit one sheet of paper or the like bearing a message to be removed and another inserted and retained in place between the two elements. The elements may be any desired mating shapes; circular disk shapes are convenient.

SUMMARY OF THE DRAWINGS

The figures of the drawings illustrate a preferred embodiment of the invention.

DETAILED DESCRIPTION WITH REFERENCE TO THE DRAWINGS

Figure 7:
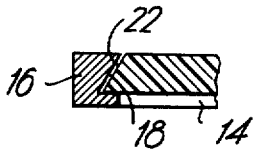
FIG. 7 is a partial section of the peripheral walls of the insertable and receiving elements in the assembled device.
Figure 4:
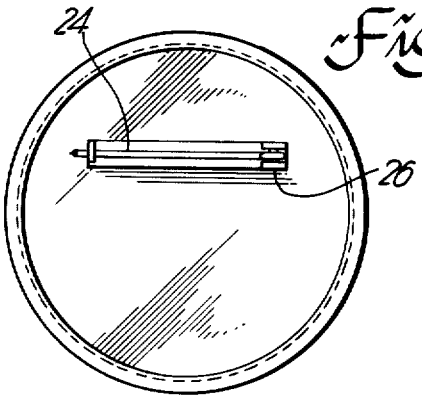
FIG. 4 is a rear view of the assembled device.
Figure 2:
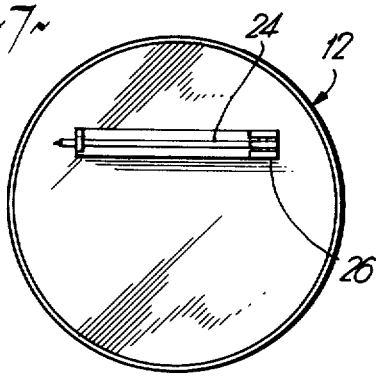
FIG. 2 is a rear view of the insertable element.
Figure 3:
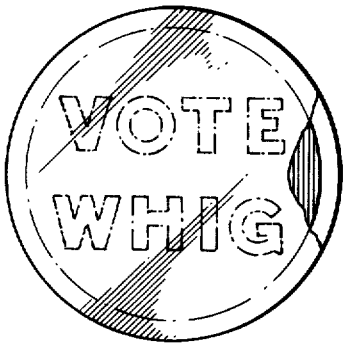
FIG. 3 is a front view of the assembled device also illustrating a message disc clamped between the insertable element and the receivable element.
Figure 1:
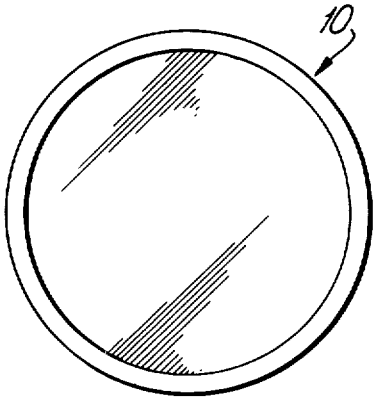
FIG. 1 is a rear view of the receiving element.
Figure 5:
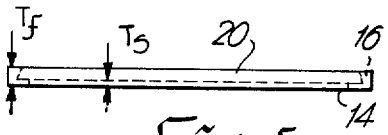
FIG. 5 is an edge view of the receiving element.

FIG. 1 illustrates the rear of a receiving element 10 in the form of a generally flat disk made of clear flexible material, e.g. a suitable transparent plastic such as polyvinyl chloride or an acrylic, which has a recessed area 20 (see FIG. 5), symmetrically disposed with respect to the outside peripheral edge of the receiving element 10. An insertable element 12 also in the form of a generally flat disk as shown in FIG. 2 of clear or opaque material is constructed to fit into and mate with the recessed space 20 of the receiving element 10 to form an assembled device as shown in FIGS. 3 and 4. An edge view of the recessed space 20 seen in FIG. 5 illustrates a planar face at the bottom of the recessed space 20 and a parallel planar front face of the receiving element 10 which combine to form a thin window 14 therein. As seen in FIG. 7, the flanged annular portion 16 of the receiving element 10 encircling the recessed space 20 has an interior wall 18 which slants inwardly and upwardly from the bottom and inwardly towards the centre of the recessed space 20, and mates with a corresponding inclined surface 22 on the outside edge of the insertable element 12.

Figure 6:
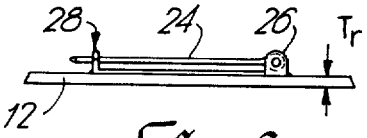
FIG. 6 is an edge view of the insertable element.

As seen in FIG. 6, pivotally attached to a mounting 26 affixed on the back surface of the insertable element 12 is a pin 24 (to permit the device to be attached to the wearer's clothing) which can be pivoted into and held in a locked position by a clasp 28, also affixed on the rear surface of the insertable element 12.

For flexibility, economy of material and aesthetic purposes, both elements should be relatively thin, with thickness Tf of the assembled device equal to the flange thickness of flange 16. This implies that $Tf = Tr + Ts$, where Tr is the thickness of the insertable device 12 and Ts is the thickness of window 14.

Figure 8:
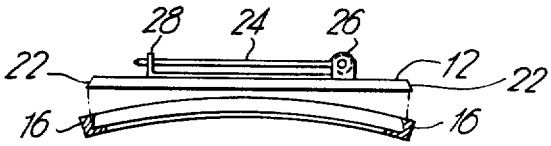
FIG. 8 is a section view of the two elements, showing the receiving element flexed to permit removal of the insertable element therefrom.

As seen in FIG. 8, the insertable element 12 may be inserted into or removed from the recessed space 20 of the receiving element 10 by flexing the latter element. This is a significant improvement over some previous display devices, which required separate metal tools to be used to change the message. When a photograph or message printed on a mating thin disk of paper or the like is placed faced-down in the recessed space 20, and the insertable element 12 fitted on top of the latter within the recessed area 20, the insertable element 12 is held in place by the inertior wall 18 of the recessed space 20, bearing against the mating wall surface 22 of the insertable element 20. The assembled device may then be pinned to a suitable external object and the message as displayed through the window 14 of the receiving element thereby exposed for viewing.

If for any reason the message is to be permanently retained within the display device (as for example in an identification badge), the device may be sealed by fusion of the mating edges of the insertable and receiving elements (by using a heat source such as a soldering gun or possibly a chemical solvent).

The walls 18, 22 may be made with relatively sharp edges; this facilitates the placing of a message-bearing sheet of paper somewhat larger than the overall diameter of insertable element 12 into the device and the subsequent trimming of the sheet of paper to size simply by cutting or tearing the paper along the periphery of insertable element 12.

Generally the message will be printed on relatively thin paper, in which case no clearance between the insertable and receiving elements need be provided. If, however, it is desired to accommodate thin cardboard or the like bearing the message, clearance could be provided and the dimensions of the two elements adjusted accordingly.

Note that the fit of the two elements 10, 12 is completely symmetrical; this enables ready alignment of the message to be effected without the restraints that exist in some prior devices which fit together only along predetermined alignment orientations and thus give rise to the possibility of message misalignment.

Although the specific embodiment of the device as described has a circular configuration, other configurations such as an ellipse or other curvilinear shape, or rectangular shape, are equally possible and still within the scope of the invention. (Bevelled or rounded corners may be desirable for rectangular-shaped devices). Alternative means of attaching the assembled device to an external object such as a loop for attachment to a chain are also contemplated by the invention herein. The flat planar construction could be replaced by a gently curved structure. The walls 18, 22 could be curved rather than straight in their inclination. Other variants and modifications will readily occur to a person skilled in the art; the invention is thus to be given the full scope set forth in the appended claims and not restricted to the embodiment disclosed.

What is claimed is:

1. A portable transparent display device comprising:

a flexible, plastic, transparent generally flat receiving element having a front face and rear face, a recessed space on the rear face thereof, said recessed space having a planar bottom surface presented towards the front face thereof and an outer periphery defined by a continuous smooth inclined interior wall extending and inclined in a direction away from the planar bottom surface and towards the center of said element;

a generally flat insertable element shaped and dimensioned to be received as a close interference fit by the recessed space of the receiving element and having a continuous smooth outer slanting wall mating with and removably retained by the said smooth inclined interior wall of the recessed space of the receiving element;

the thickness of the insertable element corresponding substantially to the depth of said recessed space;

the receiving element being resiliently deformable out of its generally flat condition to draw the periphery of said recessed space on the rear face thereof forwardly relative to the planar bottom surface of said recessed space so that the inclined interior wall of said recessed space clears the outer slanting wall of said flat insertable element to release it from retention therein;

said display device having attachment means affixed to and protruding rearwardly from the flat insertable element for use in attaching said assembled device to an external object;

the insertable element having an acute angled, sharp peripheral edge for disposition adjacent to the bottom surface of the recessed space of the receiving element, said sharp edge co-operating with the peripheral edge of the recessed space on assembly of the receiving element and the insertable element, to cut paper material disposed therebetween.

2. A device as defined in claim 1, wherein the attachment means comprises:

a bracket affixed to the rear surface of said insertable element;

a pin pivotally mounted on said bracket;

a clasp affixed to the rear surface of the said insertable element adapted to receive and removably fasten the free end of said pin in a locked position;

said clasp and pin protruding rearwardly from the rear surface of the insertable element, to an extent to permit them to be manually gripped to assist in manual separation of the insertable element from the receiving element.

3. A device as claimed in claim 2, wherein the insertable element is made of plastic.

4. A device as claimed in claim 1, wherein both the receiving element and the insertable element have an overall circular configuration and the said recessed space is symmetrically disposed with respect to the periphery of the said receiving element.

5. A portable transparent display device for displaying a message, design or the like on a thin sheet of paper comprising two removably mating and interlocking elements;

one of said elements being a generally flat insertable element having inclined peripheral edges;

the other of said elements being a generally flat receiving element for receiving the insertable element and therebetween the thin sheet of paper, said receiving element having an outer periphery constituted by a continuous narrow flange whose interior peripheral walls mate with the periphery of the insertable element, the interior peripheral walls of the flanges being smoothly and continuously inclined to form an overhanging mating grip for the peripheral edges of the insertable element, at least the flanges of the receiving element being flexible to permit the snap fit of the insertable element into the receiving element and the release of the grip of the flanges on the insertable element thereby to permit removal of the insertable element from the receiving element, each of the elements being made of a suitable, resiliently flexible plastic, the rear surface of the insertable element being substantially flush with the rear surface of the flanges when the insertable element is received and gripped by the receiving element, the insertable element having an acute angled, sharp peripheral edge for disposition adjacent to the bottom surface of the recessed space of the receiving element, said sharp edge co-operating with the peripheral edge of the recessed space on assembly of the receiving element and the insertable element, to cut paper material disposed therebetween.

6. A device as defined in claim 5, wherein the device is provided with a clasping element fixed thereto for clasping an external object, said clasping element protruding from one flat surface of said generally flat insertable element.

7. A device as defined in claim 6, wherein the elements are substantially circular in peripheral shape.

* * * * *